US006698128B2

(12) United States Patent
Kessler

(10) Patent No.: US 6,698,128 B2
(45) Date of Patent: Mar. 2, 2004

(54) ADJUSTABLE BORE PAINT BALL GUN

(75) Inventor: Eric H. Kessler, South Bend, IN (US)

(73) Assignee: National Paint Ball Supply, Inc., Sewell, NJ (US)

( * ) Notice: Subject to any disclaimer, the term of this patent is extended or adjusted under 35 U.S.C. 154(b) by 0 days.

(21) Appl. No.: 10/113,302

(22) Filed: Mar. 29, 2002

(65) Prior Publication Data

US 2003/0182838 A1 Oct. 2, 2003

(51) Int. Cl.[7] ..... F41A 21/00
(52) U.S. Cl. ..... 42/76.01 ; 89/14.05; 124/83
(58) Field of Search ..... 42/106, 76.01, 42/77, 79; 89/14.05; 124/1, 83, 84, 85

(56) References Cited

U.S. PATENT DOCUMENTS

| | | | | | |
|---|---|---|---|---|---|
| 2,466,104 | A | * | 4/1949 | Hilburn | 42/79 |
| 2,685,144 | A | * | 8/1954 | Schroeder | 42/79 |
| 2,864,629 | A | | 12/1958 | Hall, Sr. | |
| 2,894,348 | A | * | 7/1959 | Cutts | 42/79 |
| 2,922,242 | A | * | 1/1960 | Pachmayr et al. | 42/79 |
| 3,029,540 | A | * | 4/1962 | Pachmayr | 42/79 |
| 3,550,300 | A | | 12/1970 | Roder | |
| 3,708,841 | A | | 1/1973 | Quinney | |
| 3,867,778 | A | * | 2/1975 | Preda et al. | 42/79 |
| 4,644,930 | A | | 2/1987 | Mainhardt | |
| 6,273,080 | B1 | | 8/2001 | Sullivan, Jr. | |
| 6,385,891 | B1 | * | 5/2002 | Rabatin | 42/79 |
| 2002/0121040 | A1 | * | 9/2002 | Kumler | 42/79 |

FOREIGN PATENT DOCUMENTS

| | | | | |
|---|---|---|---|---|
| CA | 575041 | * | 4/1959 | 42/79 |

* cited by examiner

*Primary Examiner*—Michael J. Carone
*Assistant Examiner*—Gabriel S. Sukman
(74) *Attorney, Agent, or Firm*—Baker & Daniels

(57) ABSTRACT

A barrel with an adjustable bore diameter for use with a paint ball gun allowing the gun to fire paint ball pellets of different sizes. The barrel need not be removed from the gun in order to adjust the bore diameter, but rather an outer sleeve of the barrel is rotated to facilitate the change in the bore diameter. In one embodiment, the barrel includes an inner-bore sleeve, a barrel body having openings and force elements received in the openings. The barrel body and force elements are located between the inner-bore sleeve and outer sleeve. One embodiment includes recesses on an inner surface of the outer sleeve to rotationally index the force elements in the outer sleeve.

31 Claims, 11 Drawing Sheets

ADJUSTABLE BORE PAINT BALL GUN

BACKGROUND OF THE INVENTION

This invention relates to paint ball guns of the type usually used in recreational activities. More directly, the invention relates to a gun barrel with an adjustable diameter for use in projecting paint ball pellets with a compressed gas.

Paint ball guns are generally used for target shooting or for recreation where individuals, or teams, fire paint balls or pellets at each other in an effort to simulate combat, or war. In operation, a paint ball is deposited into a compression chamber of the paint ball gun. By pulling the trigger on the gun, the user unleashes a short blast of compressed gas (generally carbon dioxide) that propels the paint pellet out of the compression chamber, through the barrel of the gun, and out of the muzzle. To maximize the force of the compressed gas on the paint ball, the bore of the barrel of the paint ball gun should slightly compress or be close in diameter to the diameter of the paint pellet. However, a barrel with a bore that is too small for the paint pellet will require extra energy to dislodge the pellet from the barrel slowing it down or in extreme circumstances, causing it to become lodged in the barrel or causing the pellet to break apart while traveling down the barrel. Conversely, a barrel with a bore much larger than the paint pellet will allow the compressed gas to leak around it, reducing the force of the gas upon the pellet, resulting in a slower muzzle velocity and less range.

Paint pellets are produced by many different manufacturers and vary in their spherical diameters. As traditional paint ball guns have a barrel that is not adjustable, some paint pellets may not fire effectively because of the differing spherical diameters.

It has been known to compensate for spherical deviation of paint pellets by using removable barrels that can be replaced with barrels of differing bore sizes. This is achieved, in the prior art, by the addition of a quick disconnection mechanism. Such a paint ball gun barrel is disclosed in U.S. Pat. No. 6,273,080 to D. Sullivan, Jr. incorporated herein by reference. A quick disconnect barrel system, however, requires the user to carry numerous barrels of differing bore diameters to ensure availability of a bore properly matching the size of the paint pellets to be fired.

It has also been known to use interchangeable bore sleeves of varying diameter or to use pins with a spring loaded tension to position the paint pellet in the barrel of the gun. The pins are placed around the interior of the barrel at 3 or 4 locations. However, as the pins provide only point contact, compressed gas may be lost around the paint pellet by traveling between the pellet and the inner wall of the barrel.

SUMMARY OF THE INVENTION

In one embodiment of the present invention, a barrel for a paint ball gun having an adjustable bore is provided. The barrel includes an adjustment mechanism that compresses an inner-bore sleeve to numerous diameters, allowing the paint ball gun to fire paint pellets of different sizes.

The adjustment mechanism is capable of adjusting the inner diameter of the barrel without having to remove the barrel from the paint ball gun. In one embodiment of the invention, rotation of an outer collar around the barrel is sufficient to alter the diameter of the barrel.

One embodiment of the invention includes a resilient inner-bore sleeve capable of springing back to a larger diameter whenever the compression force is removed. The inner-bore sleeve should be sufficiently resilient to continually return to its initial rest dimensions, thereby ensuring the same maximum barrel diameter may always be achieved by the adjustable bore barrel.

With the present invention, the user is able to accurately set the diameter of the bore without having to carry replacement barrels, attachments, or measuring devices. Any one of numerous well known alignment mechanisms may be used to allow the user to accurately set the diameter of the bore. The alignment mechanisms allow the user to set the bore diameter for more efficient utilization of the compressed air charge of the gun during firing. Furthermore, the alignment mechanisms allow the user to experiment in the use of different types of paint pellets enabling the user to compare various brands and various sizes without the need to purchase additional paint ball guns.

DETAILED DESCRIPTION OF THE INVENTION

Figure 1:
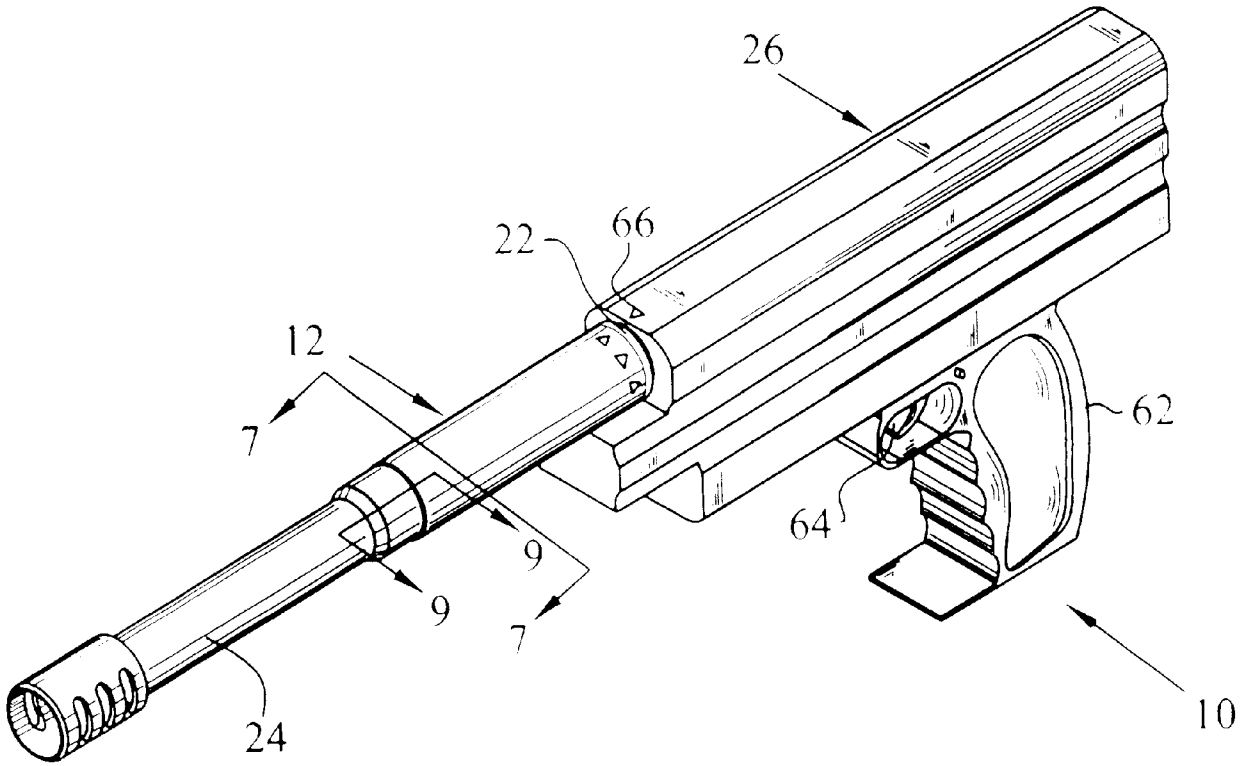
FIG. 1 shows a perspective view of a paint ball gun including a barrel with an adjustable bore.

With respect first to FIG. 1, a paint ball gun generally indicated by the numeral 10 is shown. Paint ball gun 10 includes an adjustable barrel generally indicated as 12, a muzzle or barrel extension 24, and a main body portion 26.

Figure 2:
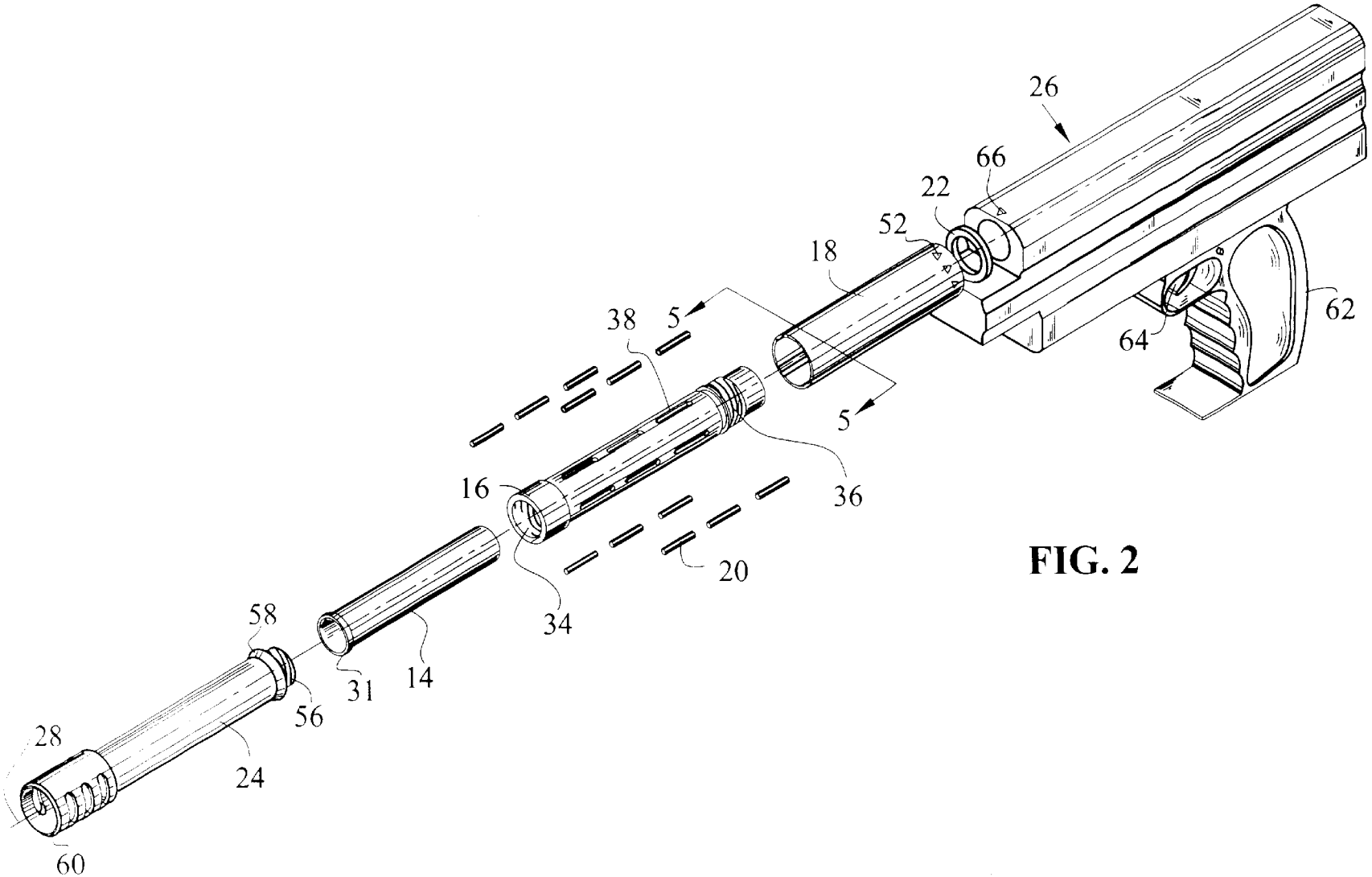
FIG. 2 shows an exploded perspective view of the embodiment of the present invention shown in FIG. 1.

As shown in FIG. 2, the adjustable barrel 12 includes an inner-bore sleeve 14, a barrel body 16, an outer sleeve or collar 18, a plurality of force elements 20 and a retaining ring or stop spacer 22. In one embodiment of the invention, inner-bore sleeve 14, barrel body 16, outer sleeve 18, retaining ring 22 and barrel extension 24, all share an identical longitudinal axis 28.

Figure 3B:
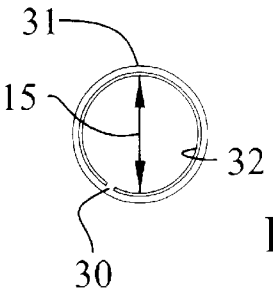
FIG. 3B is an end view of the inner-bore sleeve of FIG. 3.
Figure 3A:
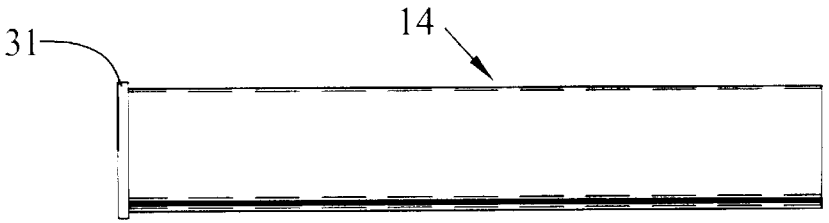
FIG. 3A is a side view of the inner-bore sleeve of FIG. 3.
Figure 3:
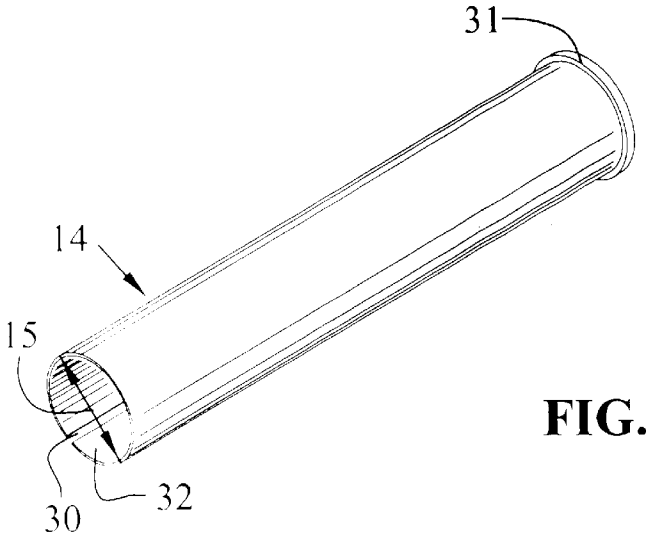
FIG. 3 shows a perspective view of an embodiment of an inner-bore sleeve shown in FIG. 2.

FIGS. 3, 3A, and 3B show one embodiment of inner-bore sleeve 14, including a longitudinal slit 30 and a flange 31. In one embodiment, inner-bore sleeve 14 is manufactured from an aluminum composite and has a smooth inner-bore 32. In addition, inner-bore sleeve 14 has an at-rest diameter 15. At-rest diameter 15 is the diameter that inner-bore sleeve 14 will naturally hold when no compressing force is exerted upon it. However, when a compressing external force is exerted upon inner-bore sleeve 14, the width of longitudinal slit 30 decreases, and inner-bore sleeve 14 compresses, reducing the diameter.

Flange 31 is located at one end of the inner-bore sleeve 14. Flange 31 has an outer diameter that is larger than the outer diameter of inner-bore sleeve 14 for use in assembly of the adjustable barrel in a manner discussed below.

Figure 4:
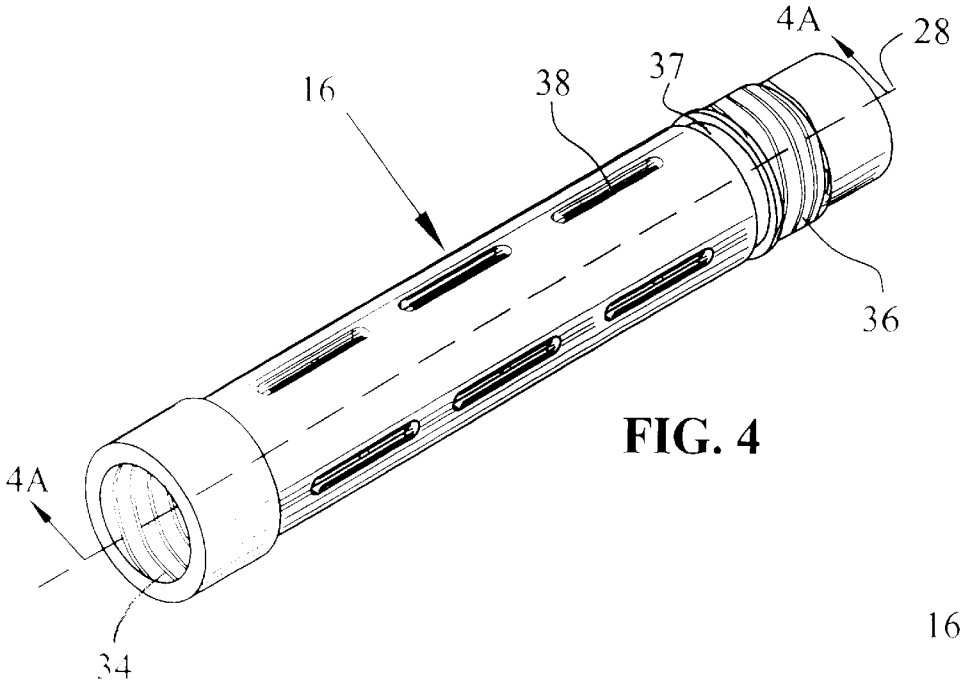
FIG. 4 shows a perspective view of an embodiment of a barrel body shown in FIG. 2.
Figure 4A:
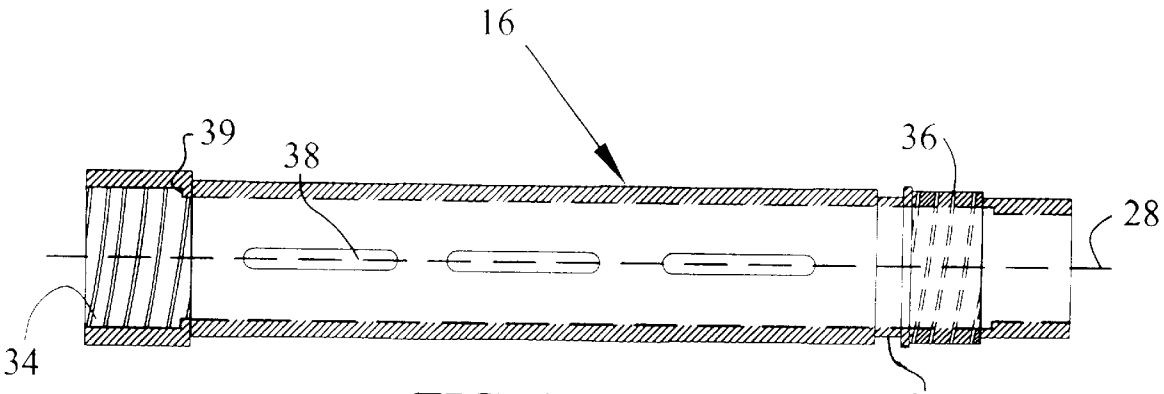
FIG. 4A is a longitudinal cross-sectional view of the barrel body taken along line 4A—4A of FIG. 4.

Referring now to FIGS. 4 and 4A, the barrel body 16 is shown. Barrel body 16 has a generally cylindrical shape around longitudinal axis 28. Barrel body 16 includes barrel threads 34, gun threads 36, a bearing surface 37 adjacent the gun threads, and a plurality of openings 38. A shoulder 39 is located on the interior of barrel body 16 adjacent barrel threads 34. In one embodiment of the invention, the gun threads 36 are male threads sized to mate with female threads (not shown) in the main body portion 26 of gun 10 for securing the assembled adjustable barrel 12 thereto. It should be noted that the gun threads 36 may be female if necessary to complement the threads of the main body portion 26.

Barrel threads 34 are located on the end of barrel body 16 opposite gun threads 36. Barrel threads 34 may be either male or female threads with the choice being arbitrary as long as the type of threads chosen mate for attachment with threads on barrel extension 24. The embodiment shown in FIG. 4 depicts barrel threads 34 as female threads. An embodiment as shown in which the barrel threads 34 and the gun threads 36 are each of different type, i.e., one being male and one being female, allows the user to make a quick distinction as to which end is the barrel threads 34 and which end is the gun threads 36 without the need for marking the barrel.

In the embodiment shown, the barrel openings 38 are elongated holes through the barrel body 16 of sufficient size and shape as to allow force elements 20 to pass through the barrel body 16, yet limit movement of the force elements, in a manner described below.

Referring again to FIG. 2, one embodiment of the force elements 20 that may be utilized in the present invention is shown. The force elements 20 are roller pins made from a hard plastic or metallic material and positioned in such a position that the longitudinal axes of the pins are generally parallel to the longitudinal axis 28 of the adjustable barrel 12.

Figure 5:
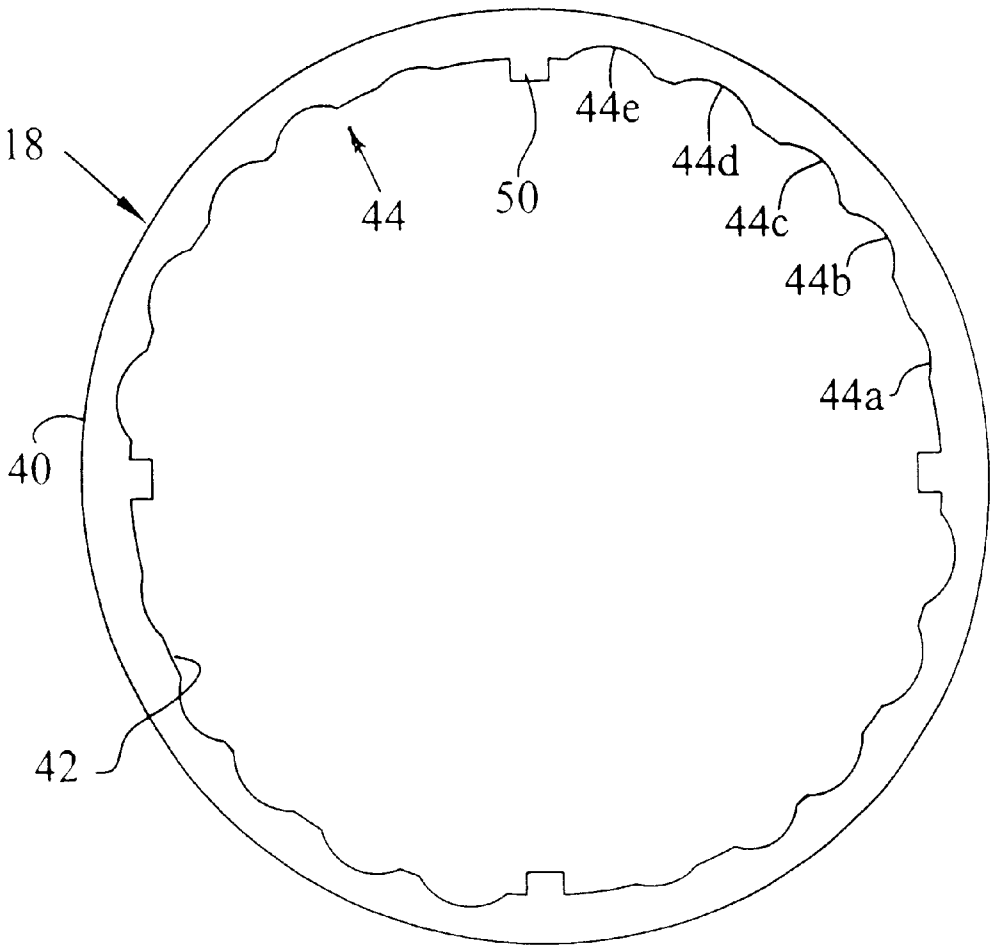
FIG. 5 is a cross-sectional view of one embodiment of an outer sleeve taken along line 5—5 in FIG. 2.

Referring to FIGS. 2 and 5, outer sleeve 18 has a generally hollow cylindrical shape. In one embodiment, outer sleeve 18 is cast or machined from a metallic material such as aluminum. Outer sleeve 18 includes an outer surface 40, an inner surface 42, a plurality of recesses generally indicated at 44, and rotational stops 50. Outer sleeve 18 may also include marking indicators 52 for indicating the setting of the adjustable barrel 12 as is described more fully below. The recesses 44 vary in depth to allow distinct barrel diameter adjustments in the manner described below. In the arrangement of FIG. 2, recesses 44 extend in a longitudinal manner generally parallel to axis 28 allowing for the reception of the roller pins 20. In this embodiment, outer sleeve 18 has four similar quadrants. Each quadrant is separated by a rotational stop 50. Each quadrant has five recesses 44*a*–44*e* varying in depth from the shallowest recess 44*a* to the deepest recess 44*e*.

Figure 8A:
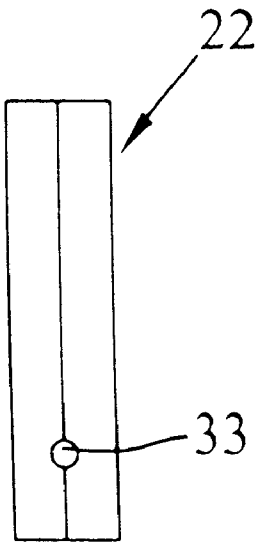
FIG. 8A is a side view of the retaining ring shown in FIG. 8.
Figure 8:
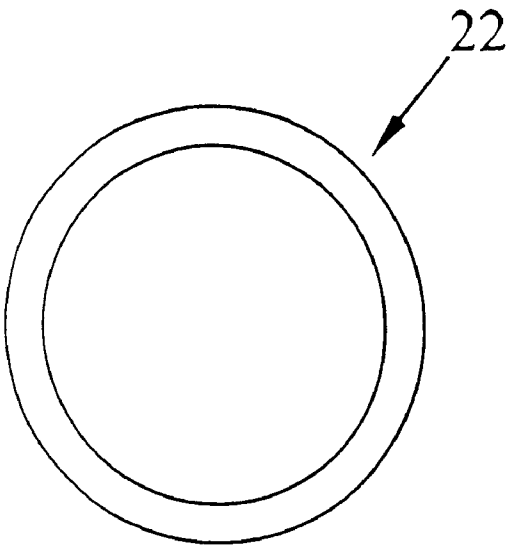
FIG. 8 is a front view of an embodiment of a retaining ring shown in FIG. 1.

Referring now to FIGS. 8 and 8A, retaining ring 22 is shown in detail. In one embodiment, retaining ring 22 is generally made from a metallic or hard plastic material and is generally shaped as a circular ring. FIG. 8A shows a side view of retaining ring 22 including a screw hole 33. Screw hole 33 is generally a threaded through hole allowing receipt of a small screw (not shown) or similar means used to hold retaining ring 22 after being positioned on the adjustable barrel 12. In this embodiment, the retaining ring 22 includes three screw holes 33 located near the center of the width of the retaining ring and spaced at approximately 120° around the circumference. Of course, any number of screw holes 33 may be used to fix retaining ring 22 on the adjustable barrel 12.

Figure 9:
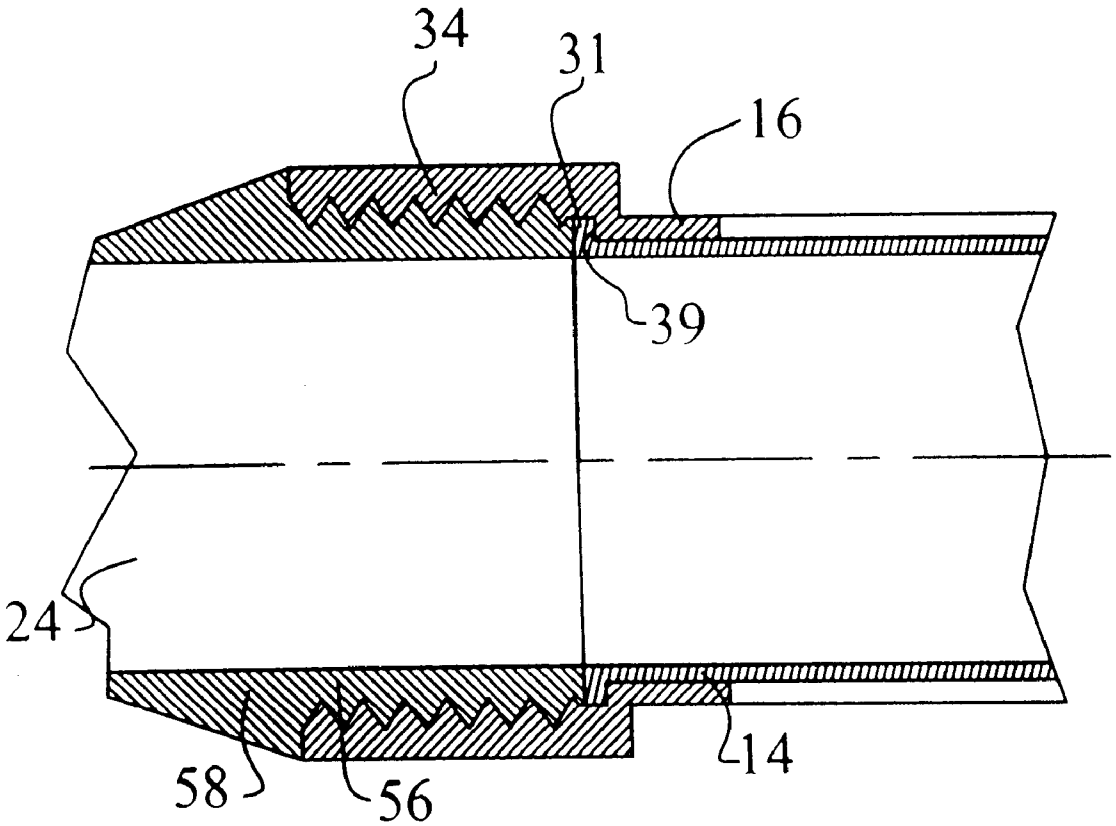
FIG. 9 is a longitudinal cross-sectional view of the barrel assembly taken along line 9—9 in FIG. 1 showing a flange of the inner-bore sleeve retained by the barrel body and a barrel extension.

As can be seen in FIGS. 2 and 9, barrel extension 24 has a threaded end 56 for attachment to the barrel body 16, a flange 58, and a distal end 60, where paint pellets exit the paint ball gun 10. Distal end 60 may include slits or other ornamentation as shown which do not affect the functionality of the gun.

The main body portion 26 includes a handle 62 having a trigger 64. Along the top of main body portion 26 is an indexing line 66 that is generally aligned along longitudinal axis 28 for use as an indexing indicator for the adjustable barrel 12

To assemble paint ball gun 10, inner-bore sleeve 14 is inserted into barrel body 16 with the flange 31 located at the end of the barrel body configured to receive barrel extension 24. Barrel extension 24 is then screwed into the barrel body 16 to hold the inner-bore sleeve 14 in place by clasping flange 31 between the threaded end 56 of barrel extension 24 and shoulder 39 of barrel body 16 (FIG. 9). Force elements 20 are then inserted into the openings 38 of the barrel body 16. The force elements 20 are precluded from going all the way through openings 38 because they contact inner-bore sleeve 14 which is inside the barrel body. Outer sleeve 18 is then slipped over this subassembly holding the force elements 20 in position. Outer sleeve 18 is secured in position with retaining ring 22, by tightening the screws (not shown) extending through holes 33 onto bearing surface 37 of barrel body 16.

Figure 7A:
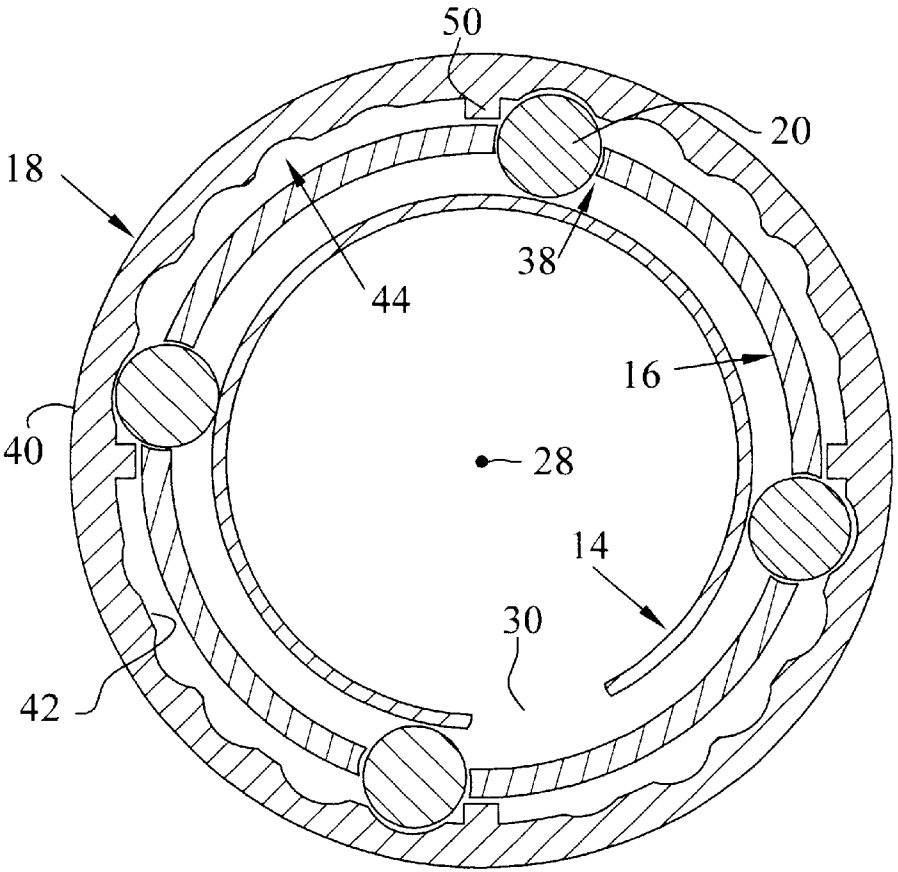
FIG. 7A is a cross-sectional view of the adjustable barrel assembly taken along line 7—7 in FIG. 1 showing the barrel in the largest bore setting.
Figure 7B:
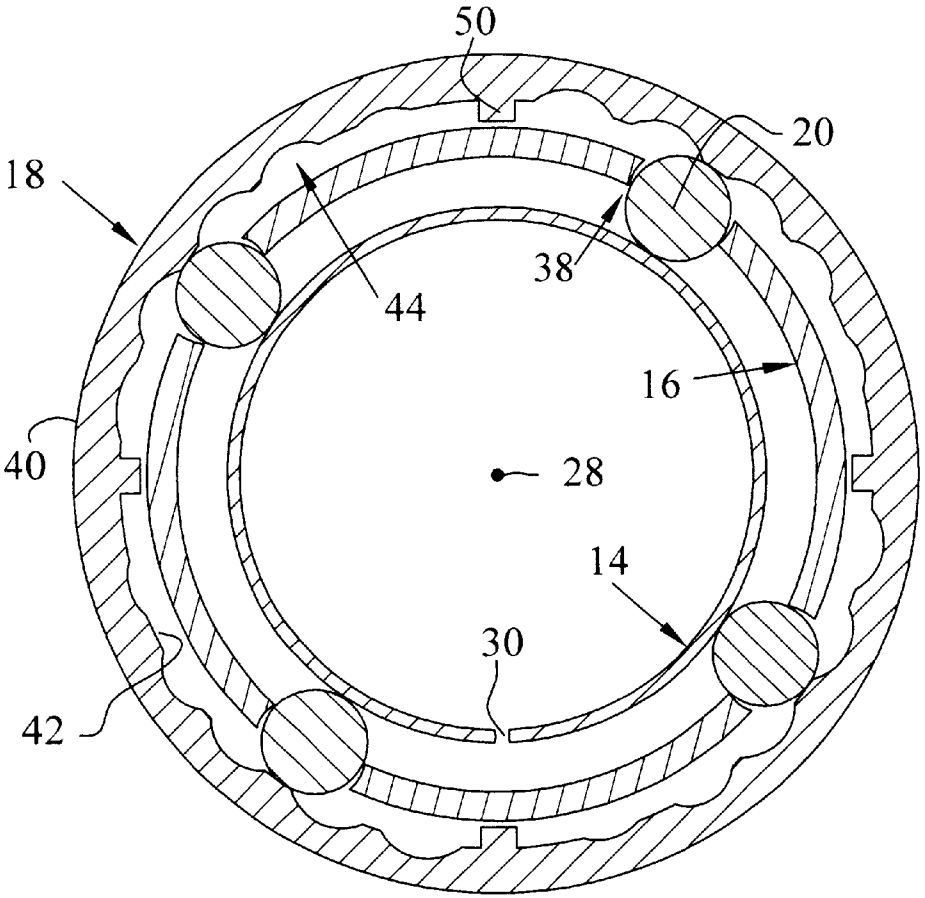
FIG. 7B is a cross-sectional view of the adjustable barrel assembly taken along line 7—7 in FIG. 1 as would appear when being moved between settings.
Figure 7C:
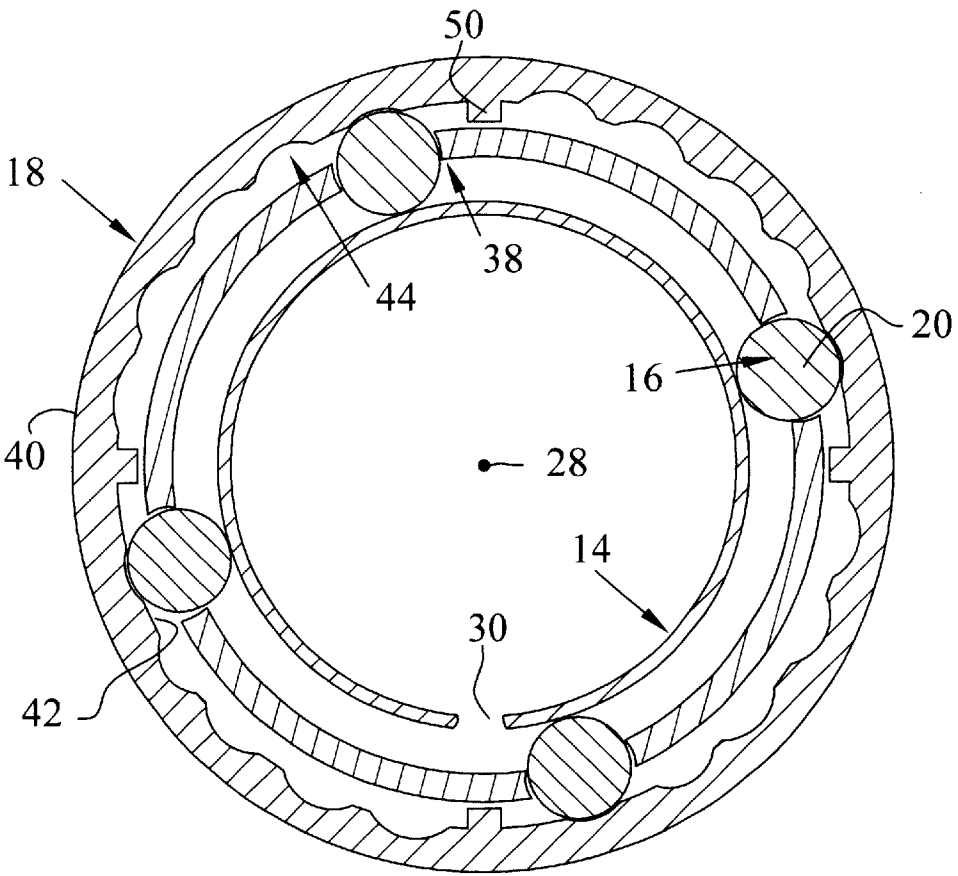
FIG. 7C is a cross-sectional view of the adjustable barrel assembly taken along line 7—7 in FIG. 1 showing the barrel in the smallest bore setting.

Referring now to FIGS. 7A–7C, the arrangement of these components is displayed in a sectional view. Generally, force elements 20 are compressed between inner surface 42 of outer sleeve 18 and the exterior of inner-bore sleeve 14. Outer sleeve 18 and inner-bore sleeve 14 limit the movement of force elements 20 radially inward or outward from the longitudinal axis 28, but the force elements can roll around the circumference of the inner-bore sleeve 14 in the openings 38 of the barrel body 16. The openings 38 are of sufficient size to allow the force elements 20 to pass freely through the openings while still maintaining the circumferencial position of the force elements. It should also be noted, the spacing of openings 38 corresponds to the spacing between like sized recesses 44*a*–44*e* between each quadrant of outer sleeve 18.

Once the adjustable barrel 12 is assembled, gun threads 36 are generally of a standard type allowing replacement of standard paint ball gun barrels with the improved adjustable barrel 12 disclosed herein. An operator with a standard barrel may unscrew and remove the standard barrel from a standard paint ball gun and then attach the disclosed adjustable barrel 12. This feature allows many standard paint ball guns currently on the market to fire paint ball ammunition pellets of varying diameters without the need to purchase a new paint ball gun for installation of adjustable barrel 12.

To operate the adjustable barrel assembly 12, an operator may rotate the outer sleeve 18 around the longitudinal axis 28 to adjust the diameter of the inner-bore sleeve 14 to optimize the fit of the paint pellet in the barrel. In order to set the desired inner-bore sleeve 14 diameter, the operator must supply a rotational force upon the outer sleeve 18 sufficient to rotate it, causing force members 20 to ride against the inner surface 42. The operator would then continue rotation until the desired diameter of inner-bore sleeve 14 is achieved. It should also be appreciated that a certain amount of resistance is encountered when rotating outer sleeve 18 until force elements 20 roll out of the recesses 44 into which they are seated such that the set diameter tends to remain fixed until purposely changed by the operator. Outer surface 40 may be contoured in a manner such that the operator may obtain a better grip on the outer sleeve 18 to facilitate rotation of the outer sleeve 18 around the longitudinal axis 28.

In operation, the plurality of recesses 44*a*–44*e* of outer sleeve 18 form an adjustment means in combination with the force elements 20 and barrel body 16 for adjusting the diameter of the inner-bore sleeve 14. Recesses 44 are shaped to receive force elements 20 as shown. Outer sleeve 18 is relatively inflexible compared to inner-bore sleeve 14, causing the diameter of inner-bore sleeve 14 to become smaller as the force elements 20 are moved from a deeper to a more shallow recess 44. Likewise because of the resilient nature of inner-bore sleeve 14 when the force elements are moved from a more shallow to a deeper recess 44, the diameter of inner-bore sleeve will expand and increase.

As the diameter of the inner-bore sleeve 14 is determined by the distance between the force elements 20 and the longitudinal axis 28, the depth of the recesses 44 is directly proportional to the diameter of the inner-bore sleeve 14; i.e. the greater the depth of the recess that force elements are in, the larger the diameter of the inner-bore sleeve 14.

The use of recesses 44 allows for a plurality of distinct settings to be chosen by the operator. In the embodiment shown in FIGS. 5 and 7A–7C, outer sleeve 18 may be rotated approximately 90° about longitudinal axis 28, as contact between force elements 20 and stops 50 will prevent further rotation. Also, in this embodiment the five recesses 44*a*–44*e* in each quadrant provide five distinct diameter settings for inner-bore sleeve 14. In FIG. 7A, adjustable barrel assembly is shown with the force elements 20 and the deepest recesses 4*e* providing the largest diameter bore setting for paint ball gun 10. In FIG. 7B, the roller elements are shown as they would appear when moving the adjustable barrel from one setting of bore diameter to another. It should be noted, that at this transition point, the diameter of inner-bore sleeve 14 is smaller than when the force elements are located in any of the recesses and correspondingly, longitudinal slit 30 is narrowest at these transition points. In FIG. 7C, adjustable barrel 12 is shown with the force elements in the shallowest recess 44*a* providing the smallest diameter bore setting for inner-bore sleeve 14. It is possible for an operator to determine which recess the force elements are indexed in by the alignment of marking indicators 52 on outer sleeve 18 with the indexing line 66 on the main body portion 26 of gun 10. The indexing line 66 on main body portion 26 may be a notch or marking of a different color designed to give the operator a reference point. The marking indicators 52 on the outer sleeve 18 correspond to various settings for the diameter of the inner-bore sleeve 14. The marking indicators may be numbers or lines and may be inscribed, painted, or marked in any of a number of well known methods upon the outer surface 40 of the outer sleeve 18.

As is apparent from the foregoing, the inner-bore sleeve 14 is the controlling diameter with which the paint ball pellet will travel within the barrel 12 of paint ball gun 10. As such, the ability to compress inner-bore sleeve 14 determines the adjustability of the adjustable barrel 12. Therefore, any embodiment of inner-bore sleeve 14 which allows for compression in a manner similar to that shown in FIG. 2 may be substituted in this invention. For example, a spiral spring shaped inner-bore sleeve 14 with an inner diameter that may be reduced upon exertion of external forces toward the longitudinal axis 28 may be readily substituted for the inner-bore sleeve 14 with longitudinal slit 30.

However, it is believed that an advantage is gained when using an inner-bore sleeve 14 with a longitudinal slit 30. Generally, paint ball pellets (not shown) are round, plastic containers filled with paint that explode upon impact with an opponent, dispersing the paint contained therein. In competition, it is advantageous to have a gun that fires straight and for the greatest distance, enabling the user to shoot at targets while staying out of range from their weapons. It is believed that longitudinal slit 30 has the effect of decreasing the rotation of the paint balls fired from paint ball gun 10, thereby increasing the distance and speed of the ball. Further, this also increases the accuracy of the gun as less rotation of the paint ball pellet equates to straighter flight. In addition, it is believed that a paint gun 10 using the adjustable barrel 12 of the present invention may be adjusted to shoot the same distance as a standard gun by using a lower gas charge, thereby increasing the number of shots that may be taken with one carbon dioxide canister load.

In another embodiment of the invention, ball bearings (not shown) may be used as the force elements 20 in place of the roller pins. The ball bearings may be round metallic or hard plastic spheres capable of providing the force necessary to compress the inner-bore sleeve 14. Although the recesses 44 may be of any shape to hold the diameter of the inner-bore sleeve 14 constant, when the force elements 20 are ball bearings, it is desired that the recesses 44 located within the inner surface 42 be complimentary to the shape of the ball bearings. This helps to ensure the operator will have an increased level of repeatability when adjusting the diameter of the inner-bore sleeve 14.

Figure 6:
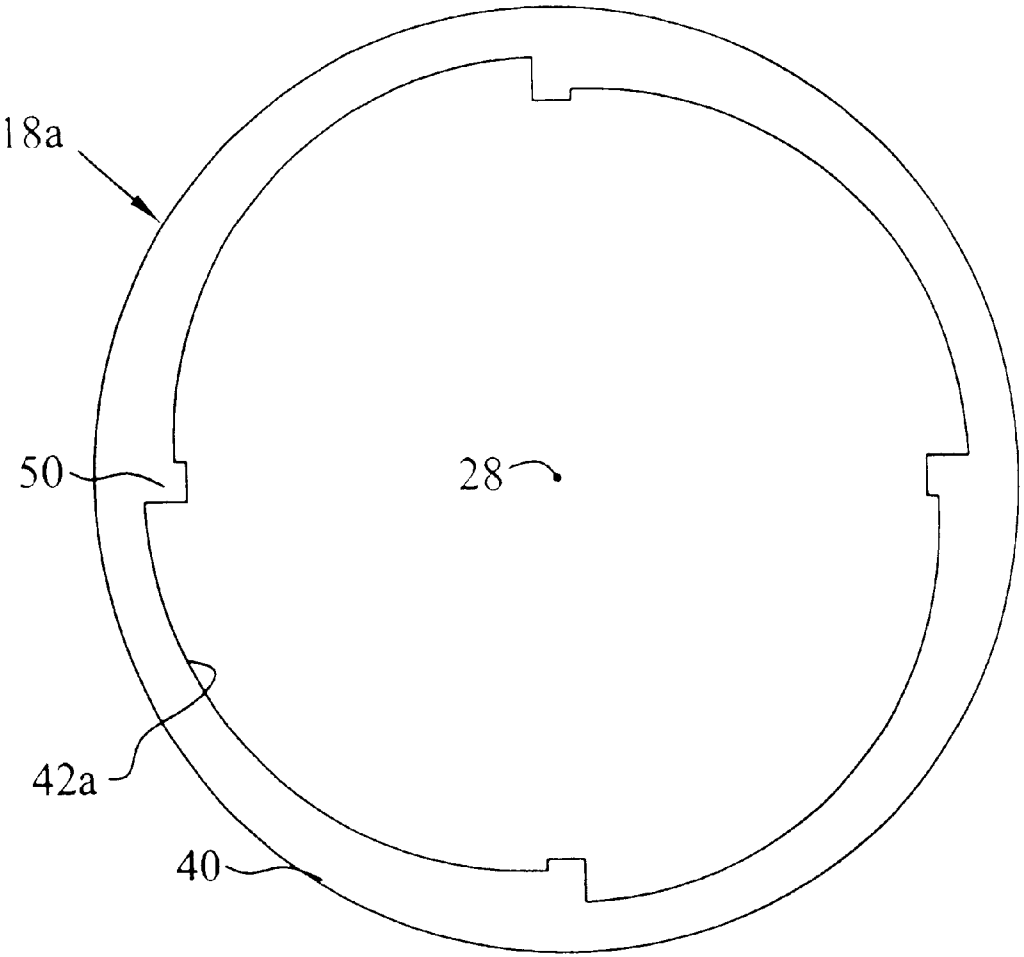
FIG. 6 shows a cross-sectional view of another embodiment of an outer sleeve.

Although any shaped force elements, capable of withstanding the crush force on the inner-bore sleeve may be used in the invention, generally, it is desirable to minimize the friction of force elements 20 against the inner-bore sleeve 14 unless a configuration such as shown in FIG. 6 as described below is used for the outer sleeve. In addition to the force elements 20 discussed above, which rotate with respect to inner-bore sleeve 14, it is anticipated that other force elements capable of sliding along the outer surface of the inner-bore sleeve 14 may be substituted. An advantage to the use of a sliding force element is that the need for recesses 44 may be eliminated as the friction of the force element itself may be sufficient to hold the outer collar 18 in position when adjusting the diameter of the inner-bore sleeve 14. A drawback to the use of sliding force elements 20 is that, over time, wear may occur on the outer surface of the inner-bore sleeve 14 and on the inner surface of the outer sleeve 18, along with wear to the actual force element itself. A wearing in any of these three components may affect the accuracy of the settings. In addition, wear may increase the presence of particulate matter in the inner-bore sleeve 14 with particulates from the force elements 20 breaking free and slipping into the bore.

Referring now to FIG. 6, another embodiment of the outer sleeve is depicted and referred to by the designation 18*a*. This embodiment includes a plurality of rotational stops 50 and a substantially smooth inner surface 42*a*. Inner surface 42*a* slopes from a distance closer to the longitudinal axis 28 to a distance farther from the longitudinal axis 28. Further, each portion of inner surface 42*a* located between the stops 50 has substantially the same shape and slope. This embodiment differs from the above described embodiment depicted in FIG. 5 in that it allows for gradual adjustment of the barrel diameter in the manner described below, as opposed to indexed movement. In this embodiment, the operator may set the inner-bore to any of an infinite number of diameters. In the embodiments shown, stops 50 are all the same distance from longitudinal axis 28. However, with this arrangement, the operator may sacrifice some repeatability when selecting the diameter as there is no indexing means provided.

From the foregoing, it should be readily apparent that the inner surface 42 may be of any shape which has portions differing in distance from the longitudinal axis 28 to provide the varying diameter on inner-bore 14. For example, an inner surface 42 including protrusions (not shown) in place of the recesses 44 may be used to further compress the force elements 20, decreasing the diameter of the inner-bore sleeve 14. It is also contemplated that the invention may be accomplished with the use of an integral force element 20 by providing a camming surface (not shown) on the exterior surface of inner-bore sleeve 14. A mating cam surface on the outer sleeve 18 could then be used to adjust the diameter of the bore by directly compressing or allowing inner-bore sleeve 14 to return to its at-rest diameter when the outer sleeve is rotated. The two embodiments of the outer sleeve 18 disclosed above are merely meant to serve as illustrative examples of configurations that may be used for inner surface 42.

Although the present invention is shown and described in detail above, the same is for purposes of example only and is not intended to limit the scope of the invention. Numerous changes and variations to the disclosed embodiment will be readily apparent to those skilled in the art without departing from the invention. Accordingly, the scope of the present invention is to be limited only by the terms of the claims.

I claim:

1. A barrel having an adjustable bore for use with a paint ball gun, the barrel including:

a compressible resilient inner-bore sleeve having a diameter;

at least one force element;

a barrel body having a plurality of openings allowing receipt of the force elements, the inner-bore sleeve being compressible relative to the barrel body; and an outer collar having a longitudinal axis, wherein rotation of the outer collar around the longitudinal axis changes the diameter of the inner-bore sleeve.

2. The barrel set forth in claim 1, wherein the compressible inner-bore sleeve further includes a longitudinal slit.

3. The barrel set forth in claim 1, wherein the force element and the barrel body are located between the inner-bore sleeve and the outer collar.

4. The barrel set forth in claim 1, wherein rotation of the outer collar around the barrel body changes the diameter of the inner-bore sleeve.

5. The barrel set forth in claim 1, wherein there is a plurality of force elements and the force elements are roller pins.

6. The barrel set forth in claim 5, wherein the outer collar further includes a plurality of recesses configured to receive the force elements.

7. The barrel set forth in claim 6, wherein the recesses are of differing depths.

8. The barrel set forth in claim 1, wherein the inner-bore sleeve has a flange.

9. The barrel set forth in claim 8, further including a barrel extension and wherein the flange of the inner-bore sleeve is held between the barrel body and the barrel extension.

10. The barrel set forth in claim 1, wherein the outer collar further includes an inner wall, the inner wall having a varying inner diameter such that rotation of the outer collar in a first direction decreases the diameter of the inner-bore sleeve and rotation of the outer collar in a second direction, increases the diameter of the inner-bore sleeve.

11. The barrel set forth in claim 1, wherein the openings are screw holes extending through the barrel body.

12. The barrel as forth in claim 1, wherein the openings are configured to allow the force element to pass therethrough.

13. The barrel as forth in claim 2, wherein the longitudinal slit extends for the length of and splits the inner bore sleeve.

14. A barrel having an adjustable bore for use with a paint ball gun, the barrel including:

a compressible inner-bore sleeve;

an outer collar, including a plurality of recesses, wherein the inner-bore sleeve and the outer collar are orientated along a common longitudinal axis such that rotation of the outer collar around the longitudinal axis changes the diameter of the inner-bore sleeve; and a plurality of force elements located between the inner-bore sleeve and the outer collar preventing contact between the inner-bore sleeve and the outer collar, the recesses in the outer collar configured to receive the force elements.

15. The barrel set forth in claim 14 further including a barrel body, the barrel body being located between the inner-bore and the outer collar.

16. The barrel set forth in claim 15, wherein the barrel body includes a plurality of openings for locating a plurality of force elements within the barrel.

17. The barrel set forth in claim 14, wherein the force elements are roller pins and the openings are elongated slots.

18. The barrel set forth in claim 14, wherein the inner-bore has a longitudinal slit.

19. A barrel having an adjustable bore for use with a paint ball gun, the barrel including:

a compressible resilient inner-bore sleeve having a diameter;

a plurality of force elements including roller pins;

a barrel body having a plurality of openings allowing receipt of the force elements; and an outer collar having a longitudinal axis, wherein rotation of the outer collar around the longitudinal axis changes the meter of the inner-bore sleeve.

20. The barrel set forth in claim 19, wherein the compressible inner-bore sleeve further includes a longitudinal slit.

21. The barrel set forth in claim 19, wherein the force element and the barrel body are located between the inner-bore sleeve and the outer collar.

22. The barrel set forth in claim 19, wherein rotation of the outer collar around the barrel body changes the diameter of the inner-bore sleeve.

23. The barrel set forth in claim 19, wherein the outer collar further includes a plurality of recesses configured to receive the force elements.

24. The barrel set forth in claim 23, wherein the recesses are of differing depths.

25. The barrel set forth in claim 19, wherein the inner-bore sleeve has a flange.

26. The barrel set forth in claim 25, further including a barrel extension and wherein the flange of the inner-bore sleeve is held between the barrel body and the barrel extension.

27. The barrel set forth in claim 19, wherein the outer collar further includes an inner wall, the inner wall having a varying inner diameter such that rotation of the outer collar in a first direction decreases the diameter of the inner-bore sleeve and rotation of the outer collar in a second direction, increases the diameter of the inner-bore sleeve.

28. A barrel having an adjustable bore for use with a paint ball gun, the barrel including:

a compressible resilient inner-bore sleeve having a diameter;

a plurality of force elements;

a barrel body having a plurality of openings configured to allow the force elements to pass through the barrel body; and an outer collar having a longitudinal axis, wherein rotation of the outer collar around the longitudinal axis changes the diameter of the inner-bore sleeve.

29. A barrel having an adjustable bore for use with a paint ball gun, the barrel including:

a compressible resilient inner-bore sleeve having a diameter;

at least one force element;

a barrel body having an opening configured for receipt of the force element; and an outer collar having a longitudinal axis and a plurality of longitudinally extending recesses configured to receive the force element, and wherein rotation of the outer collar around the longitudinal axis changes the diameter of the inner-bore sleeve.

30. A barrel having an adjustable bore for use with a paint ball gun, the barrel including:

a compressible inner-bore sleeve;

an outer collar, wherein the inner-bore sleeve and the outer collar are orientated along a common longitudinal axis such that rotation of the outer collar around the longitudinal axis changes the diameter of the inner-bore sleeve; and a plurality of force elements comprising roller pins for compressing the inner bore sleeve when the outer collar is rotated.

31. A barrel having an adjustable bore for use with a paint ball gun, the barrel including:

a compressible inner-bore sleeve having a substantially uniform diameter along the length thereof; and an outer collar, wherein the inner-bore sleeve and the outer collar are orientated along a common longitudinal axis such that rotation of the outer collar around the longitudinal axis changes the diameter of the inner-bore sleeve, and wherein the diameter of the inner bore sleeve remains substantially uniform along the length as the diameter changes.

* * * * *

UNITED STATES PATENT AND TRADEMARK OFFICE

CERTIFICATE OF CORRECTION

PATENT NO. : 6,698,128 B2
DATED : March 2, 2004
INVENTOR(S) : Eric H. Kessler

It is certified that error appears in the above-identified patent and that said Letters Patent is hereby corrected as shown below:

Column 8,
Line 62, delete “meter” and insert -- diameter --

Signed and Sealed this

Twenty-fifth Day of May, 2004

JON W. DUDAS
*Acting Director of the United States Patent and Trademark Office*